US011466854B2

(12) United States Patent
Planer et al.

(10) Patent No.: US 11,466,854 B2
(45) Date of Patent: Oct. 11, 2022

(54) SPARK IGNITION PILOT ASSEMBLY

(71) Applicant: The Marley Company LLC, Charlotte, NC (US)

(72) Inventors: Alex Planer, Bethlehem, PA (US); Chris Ellingwood, Tannersville, PA (US)

(73) Assignee: THE MARLEY COMPANY LLC, Charlotte, NC (US)

( * ) Notice: Subject to any disclaimer, the term of this patent is extended or adjusted under 35 U.S.C. 154(b) by 59 days.

(21) Appl. No.: 17/168,869

(22) Filed: Feb. 5, 2021

(65) Prior Publication Data

US 2022/0252266 A1 Aug. 11, 2022

(51) Int. Cl.
*F23Q 3/00* (2006.01)

(52) U.S. Cl.
CPC ..... *F23Q 3/008* (2013.01)

(58) Field of Classification Search
None
See application file for complete search history.

(56) References Cited

U.S. PATENT DOCUMENTS

2015/0323181 A1* 11/2015 Gasparini ..... F23Q 9/045 431/281
2017/0284669 A1* 10/2017 Cook ..... F23Q 7/00

* cited by examiner

*Primary Examiner* — Jason Lau
(74) *Attorney, Agent, or Firm* — Husch Blackwell LLP

(57) ABSTRACT

An apparatus for lighting a burner of a heat exchanger includes a mounting plate configured to be mounted to the heat exchanger, the mounting plate including a first and second opening, a pilot ignition rod assembly installed in the first opening, the pilot ignition rod assembly including a flame ionization rod and a terminal, and a sleeve coupled to and aligned with the second opening and configured to extend substantially through a refractory material lining a combustion chamber of the heat exchanger, the sleeve being joined to a ground rod on a distal end and a gas orifice mount on a proximal end, the gas orifice mount including a gas venturi surrounded by the sleeve, wherein the sleeve is sized to extend from the mounting plate through an opening in the refractory material lining the combustion chamber, wherein the sleeve includes a sleeve opening adjacent to the gas venturi, the sleeve opening configured to allow air from the combustion chamber to the gas venturi.

20 Claims, 6 Drawing Sheets

SPARK IGNITION PILOT ASSEMBLY

FIELD OF THE INVENTION

The disclosure generally relates to pilot ignition system. More particularly, the disclosure relates to a device for lighting a burner.

BACKGROUND OF THE INVENTION

Gas fired appliances, such as residential gas-fired boilers, often include a main gas burner to provide heat for the appliance and a pilot burner to provide a standing pilot flame to ignite the main gas burner. The pilot flame is fueled by a dedicated fuel line and is available to ignite combustible gases. Presently, boilers above 5000 MBTUH input must use a pilot for ignition to pass CSA certification. Unlike traditional standing flame pilots, spark ignitor pilot assemblies operate only when main burner operation is required. By doing this, spark ignitor pilot assemblies help to save energy.

However, spark ignitor pilot assemblies have some drawbacks. For example, because the spark tip is exposed to a high temperature when the main burner is in operation, the spark tip requires periodic cleaning to remove carbon accumulation formed as a byproduct of combustion. Further, periodic adjustment is required to maintain the spark gap between the two electrodes in a spark ignitor. Additionally, exotic materials are needed for the electrodes in order to withstand the high temperature of the main burner.

Therefore, it is an aspect of this disclosure to protect parts of a spark ignition pilot assembly from high temperature while the main burner is in operation.

SUMMARY OF THE INVENTION

An aspect of the disclosure pertains to an apparatus for lighting a burner of a heat exchanger, the apparatus including a mounting plate configured to be mounted to the heat exchanger, the mounting plate including first and second openings. A pilot ignition rod assembly is installed in the first opening, the pilot ignition rod assembly including a flame ionization rod and a terminal. The pilot ignition rod assembly also including a sleeve coupled to and aligned with the second opening and configured to extend substantially through a refractory material lining a combustion chamber of the heat exchanger. The sleeve is joined to a ground rod on one end and a gas orifice mount on the opposite end. The gas orifice mount includes a gas venturi surrounded by the sleeve, wherein the sleeve is sized to extend from said mounting plate through an opening in the refractory material lining the combustion chamber. The sleeve includes a sleeve opening adjacent to the gas venturi, the sleeve opening configured to allow air to flow from the combustion chamber to the gas venturi.

In another aspect of the disclosure, a wall opening is provided on the wall, wherein the wall opening is aligned with a refractory material opening arranged on the refractory material and is aligned with the sleeve opening, wherein air is supplied to the sleeve through the refractory material opening and the wall opening from the combustion chamber.

In yet another aspect of the disclosure, the flame ionization rod is configured to detect a flame by monitoring an electrical current flow.

BRIEF DESCRIPTION OF THE DRAWINGS

The foregoing summary, as well as the following detailed description of the invention, will be better understood when read in conjunction with the appended figures. For the purpose of illustrating the invention, the figures demonstrate embodiments of the present invention. It should be understood, however, that the invention is not limited to the precise arrangements, examples, and instrumentalities shown.

DETAILED DESCRIPTION

The foregoing and other features, and advantages of the disclosure will become more apparent from the following detailed description taken in conjunction with the accompanying drawings.

Hereinafter, a pilot assembly with an air inlet and flame ionization rod in accordance with aspects of the present disclosure will be described with reference to the accompanying drawings. The described aspects are provided so that those skilled in the art can readily understand the technical spirit of the disclosure, and thus the disclosure is not limited thereto. Drawings are provided to aid in understanding aspects of the disclosure. However, the devices and methods disclosed herein may be implemented in different ways without departing from the spirit and scope of the disclosure.

Figure 1:
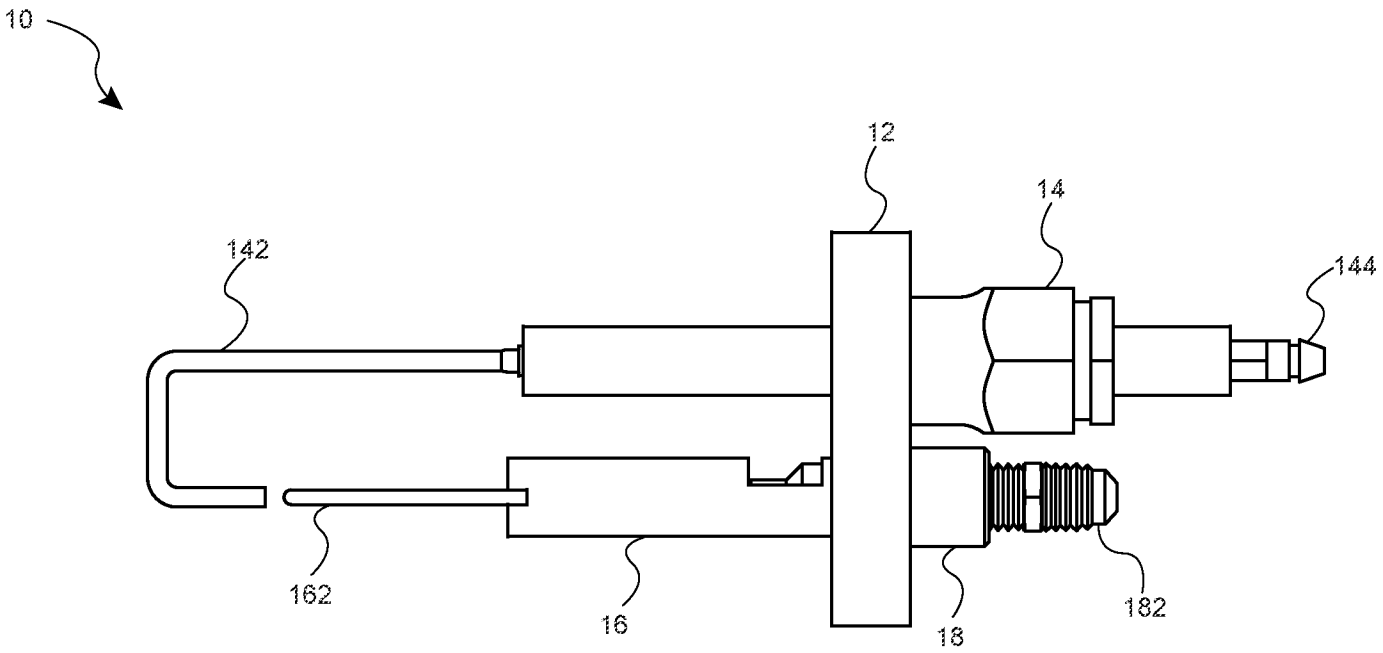
FIG. 1 is a plan view of a first side of a pilot assembly in accordance with an aspect of the present disclosure.
Figure 2:
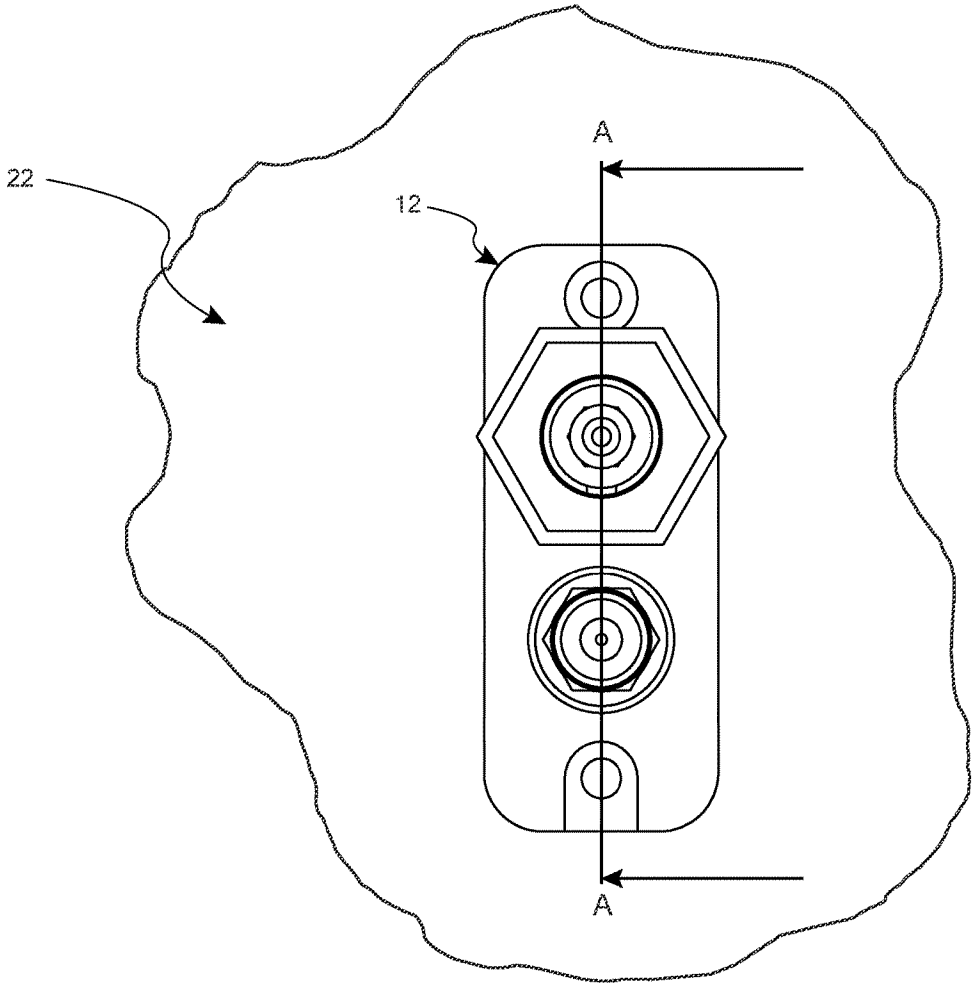
FIG. 2 is a plan view of the front of a pilot assembly in accordance with an aspect of the present disclosure.
Figure 3:
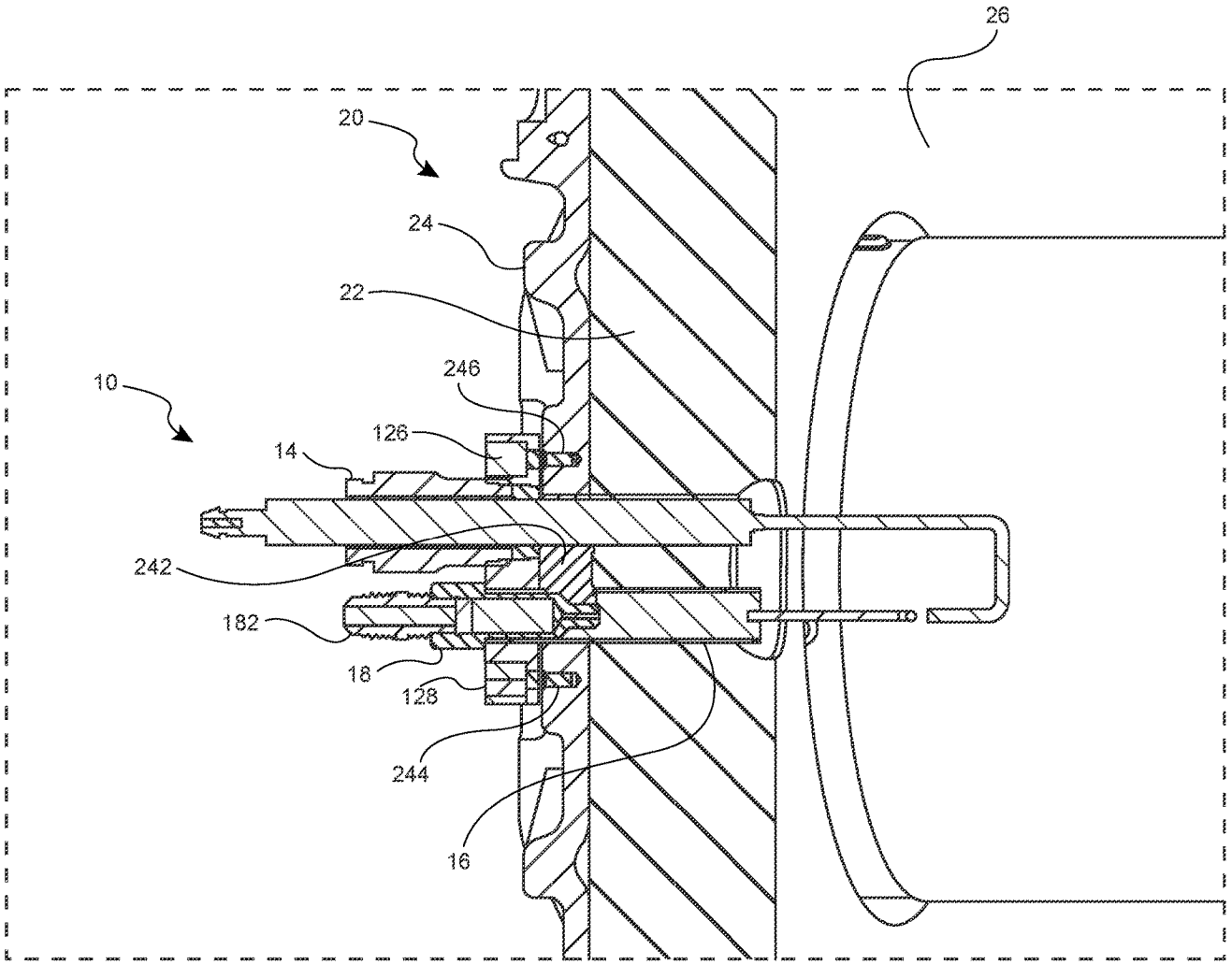
FIG. 3 is a cross sectional view taken across the line A-A of the pilot assembly of FIG. 2. mounted on a wall of the heat exchanger in accordance with an aspect of the present disclosure.

In FIG. 1, a pilot assembly 10 for lighting a burner in accordance with an aspect of the present disclosure is illustrated. The pilot assembly 10 includes a mounting plate 12. The mounting plate 12 is configured to be mounted to a wall 24 outside of the heat exchanger 20 as shown in FIGS. 2 and 3. The mounting plate 12 includes two openings, a first opening 122 and a second opening 124 as shown, for example, in FIG. 5.

The pilot assembly 10 includes a pilot ignition rod assembly 14. The pilot ignition rod assembly 14 is configured to be installed in the first opening 122 of the mounting plate 12. The pilot ignition rod assembly 14 works similar to a spark plug except that the pilot ignition rod assembly 14 has only one electrode.

The pilot ignition rod assembly 14 includes a flame ionization rod 142 (also referred to herein as an electrode) and a terminal 144. The terminal 144 is connected to, and voltage is provided by, a power source (not shown). The terminal 144 provides power to the pilot assembly 10 to generate a spark. Voltage from the power source through the terminal 144 may create a potential difference from the flame ionization rod 142 to a ground rod 162 to generate a spark. The terminal 144 may be made from any metal suitable for the purpose.

The pilot assembly 10 also includes a sleeve 16. The sleeve 16 is installed in the second opening 124 of the mounting plate 12. The sleeve 16 is sized to fit into the second opening 124. For example, the outer diameter of the sleeve 16 may be sized to be the same or slightly smaller than the inner diameter of the second opening 124. An end portion of the sleeve 16 is exposed to the combustion chamber as shown in FIG. 3. As such, the sleeve 16 needs to be heat resistant and can be made from a heat resistant material such as stainless steel.

On a first end of the sleeve 16, a gas orifice mount 18 is joined. The gas orifice mount 18 is configured to supply gas to the pilot assembly 10 from an external gas source (not shown). One end of the gas orifice mount 18 is sized to be installed in the sleeve 16. For example, the outer diameter of the gas orifice mount 18 may be the same or slightly smaller than the inner diameter of the sleeve 16. The gas orifice mount 18 may be configured to be press-fit into the sleeve 16. Alternatively, a portion of the outer diameter of the gas orifice mount 18 may be threaded into the inner thread of the sleeve 16. The gas orifice mount 18 may be configured to be installed into the sleeve with other known methods.

Another end of the gas orifice mount 18 is joined to a gas fitting 182. For example, one end of the gas fitting 182 may be threaded and may be configured to be joined to the gas orifice mount 18. The inner diameter of the gas orifice mount 18 may be threaded to be joined by the gas fitting 182. Alternatively, the gas fitting 182 may be press-fit into the gas orifice mount 18.

Another end of the gas fitting 182 is connected to a gas line (not shown). For example, the end of the gas fitting 182 may be threaded to be connected to the gas line. Alternatively, the gas fitting 182 may be connected to the gas line with a quick connect fitting. In an exemplary aspect of the disclosure, the gas fitting 182 may be made from brass.

A ground rod 162 is fixed on a second end of the sleeve 16. On the second end of the sleeve 16, a slot 166 may be formed. The slot 166 may be sized to install the ground rod 162. For example, the width of the slot 166 may be 0.1", and the thickness of the ground rod 162 may be 0.09". For example, the length of the slot 166 along the axial direction may be 0.12" and the length of the slot 166 along the circumferential direction is 0.1". The ground rod 162 may be installed in the slot 166 by press fitting. Alternatively, the ground rod 162 may be installed in the slot 166 16 by welding. For example, the ground rod 162 may be installed in the slot 166 with silver solder by silver braze at 1750° F. The ground rod 162 is exposed to the combustion chamber 26 as shown in FIG. 3, and needs to be made from a heat resistant material. For example, the ground rod 162 is made from Kanthal™ or Nichrome.

The ground rod 162 generates a spark in conjunction with the flame ionization rod 142. When a high enough voltage is applied to the flame ionization rod 142 to cross the gap between the ground rod 162 and the flame ionization rod 142, a spark is generated. The spark makes a flame when the spark interacts with the gas supplied by the gas orifice mount 18. The ground rod 162 is shaped to generate a reliable spark. For example, the ground rod 162 may be c shaped. The surface of the ground rod 162 is also configured to generate a reliable spark. For example, the surface of the ground rod 162 may be grooved or coated with other alloy materials to generate a reliable spark, to be heat resistant, oxidation resistant, and/or to have a low resistant.

The ground rod 162 is positioned so that the gap between the ground rod 162 and the flame ionization rod 142 is suitable to create a reliable spark. For example, the gap is between ⅛" and ¼".

In FIG. 2, a front of the pilot assembly 10 is shown in accordance with an aspect of the disclosure.

In FIG. 3, the pilot assembly 10 is mounted on the wall 24 of the heat exchanger 20. A refractory material 22 is located inside of the wall 24 of the heat exchanger 20. The refractory material 22 is configured to insulate the heat exchanger 20. The material and the dimension of the refractory material 22 is configured to insulate the heat exchanger 20 to improve the efficiency of the heat exchanger 20.

Figure 4:
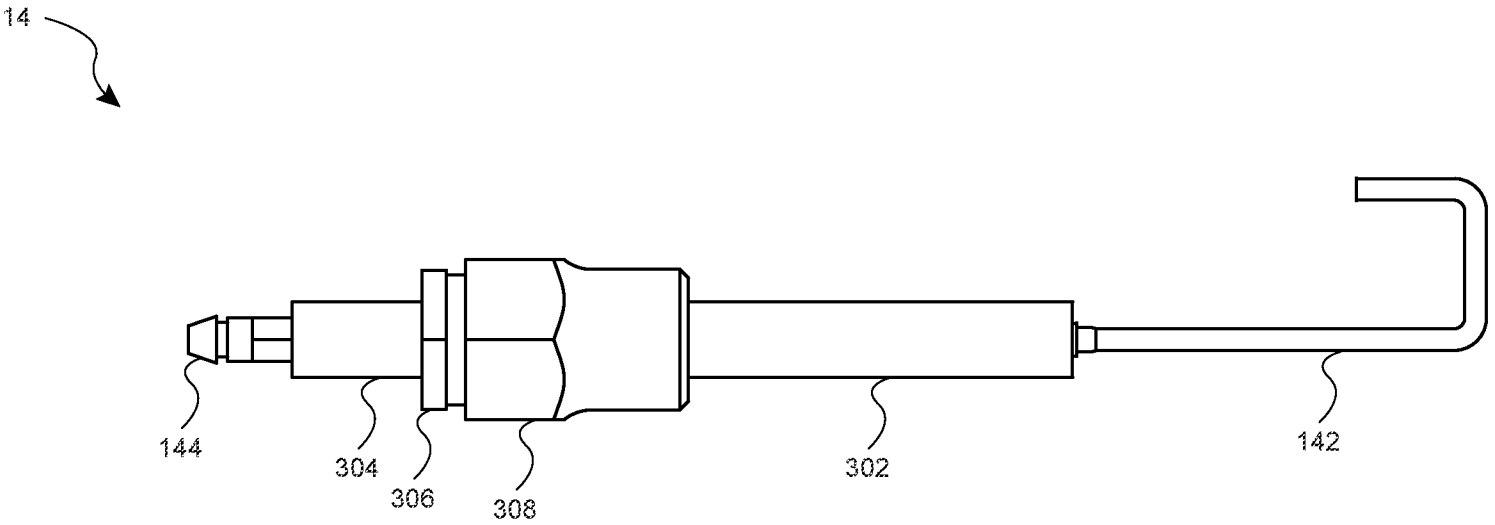
FIG. 4 is a plan view of a first side of a pilot ignition rod assembly in accordance with an aspect of the present disclosure.

In FIG. 4, details of the pilot ignition rod assembly 14 is provided. As described, the pilot ignition rod assembly 14 includes a flame ionization rod 142 and a terminal 144. The pilot ignition rod assembly 14 also includes a flame ionization rod insulator 302, a terminal insulator 304, a pilot ignition rod assembly hexagon 306, and a metal shell 308. The flame ionization rod insulator 302 covers a portion of the flame ionization rod 142. The flame ionization rod 142 is electrically connected to the terminal 144 and extends into a heat exchanger 20. The flame ionization rod insulator 302 protects the flame ionization rod 142 from the high temperature inside the heat exchanger 20. As such, the flame ionization rod insulator 302 is made from heat resistant and electrical insulating material. For example, the flame ionization rod insulator 302 is made from Alumina or Steatite ceramic.

The terminal insulator 304 protects the terminal 144 from voltage leak and damage from an outside source impact. As such, the terminal insulator 304 is made from heat resistant and electrical insulating material. For example, the terminal insulator 304 is made from Alumina or Steatite ceramic. The terminal insulator 304 may be made from a same material as the material of the flame ionization rod insulator 302. The terminal insulator 304 may be made as one body with the flame ionization rod insulator 302.

The metal shell 308 surrounds the terminal insulator 304. A first end of the metal shell 308 is sized to fit into the first opening 122 of the mounting plate 12. The first end of the metal shell 308 may be designed to be press-fit into the first opening 122 of the mounting plate 12. The first end of the metal shell 308 may also be designed to be installed into the first opening 122 of the mounting plate 12 with a sealant such as Loctite. Alternatively, the first end of the metal shell 308 may be threaded into the first opening 122 of the mounting plate 12.

A second end of the metal shell 308 may be a hexagonal. The second end of the metal shell 308 may be configured to be rotated to install the pilot ignition rod assembly 14 into the first opening 122 of the mounting plate 12. Alternatively, the pilot ignition rod assembly 14 may additionally include the pilot ignition rod assembly hexagon 306. The pilot ignition rod assembly hexagon 306 may be configured to install the pilot ignition rod assembly 14 in the mounting plate 12. In this case, the second end of the metal shell 308 is configured to act as a holder to fix the pilot ignition rod assembly 14 while rotating the pilot ignition rod assembly hexagon 306. The pilot ignition rod assembly hexagon 306 and the metal shell 308 may be made from any metal suitable for the purpose.

In exemplary aspects of the disclosure, the flame ionization rod 142 may be made from alumina, Kanthal™, or Nichrome to be resistant to high temperature and corrosion. The flame ionization rod 142 may be in a hook shape. A tip of the flame ionization rod 142 can be shaped to generate a reliable spark. For example, the tip of the flame ionization rod 142 may be sharpened. Alternatively, the tip of the flame ionization rod 142 may be coated with other alloy material suitable for heat resistance, oxidation resistance, and/or having a low resistant. For example, the coating may be made from platinum, iridium, or rhodium but may be made from other material suitable for the purpose.

A common way to detect flame is to use a UV scanner. Using a UV scanner creates additional cost because it requires additional electrical components including, for example, a UV scanner. UV scanners for use in heat exchangers are more expensive than regular ones because the UV scanner must be resistant to the high temperature of a combustion chamber and therefore is required to be made from heat resistant material. To reduce unnecessary costs, the flame ionization rod 142 of the present disclosure is configured to monitor current flow in the pilot assembly 10 as will now be described in connection with an exemplary aspect of the disclosure.

When the pilot assembly 10 is turned on, a high voltage is supplied to the terminal 144 from a power source (not shown), creating a high voltage potential to generate a spark in a gap between the flame ionization rod 142 and a ground rod 162. For example, the high voltage is between 12,000V-25,000V, but it may go up to 45,000V. The generated spark ignites a gas supplied through a gas nozzle described below in order to ignite gases supplied through a burner in the heat exchanger. After a flame is established from the burner, a low voltage is supplied to the terminal 144 and ionized gas allows a current to flow from the flame ionization rod 142 to the ground rod 162. By monitoring this current, it is possible to detect a flame, eliminating a need for a UV scanner.

Figure 5:
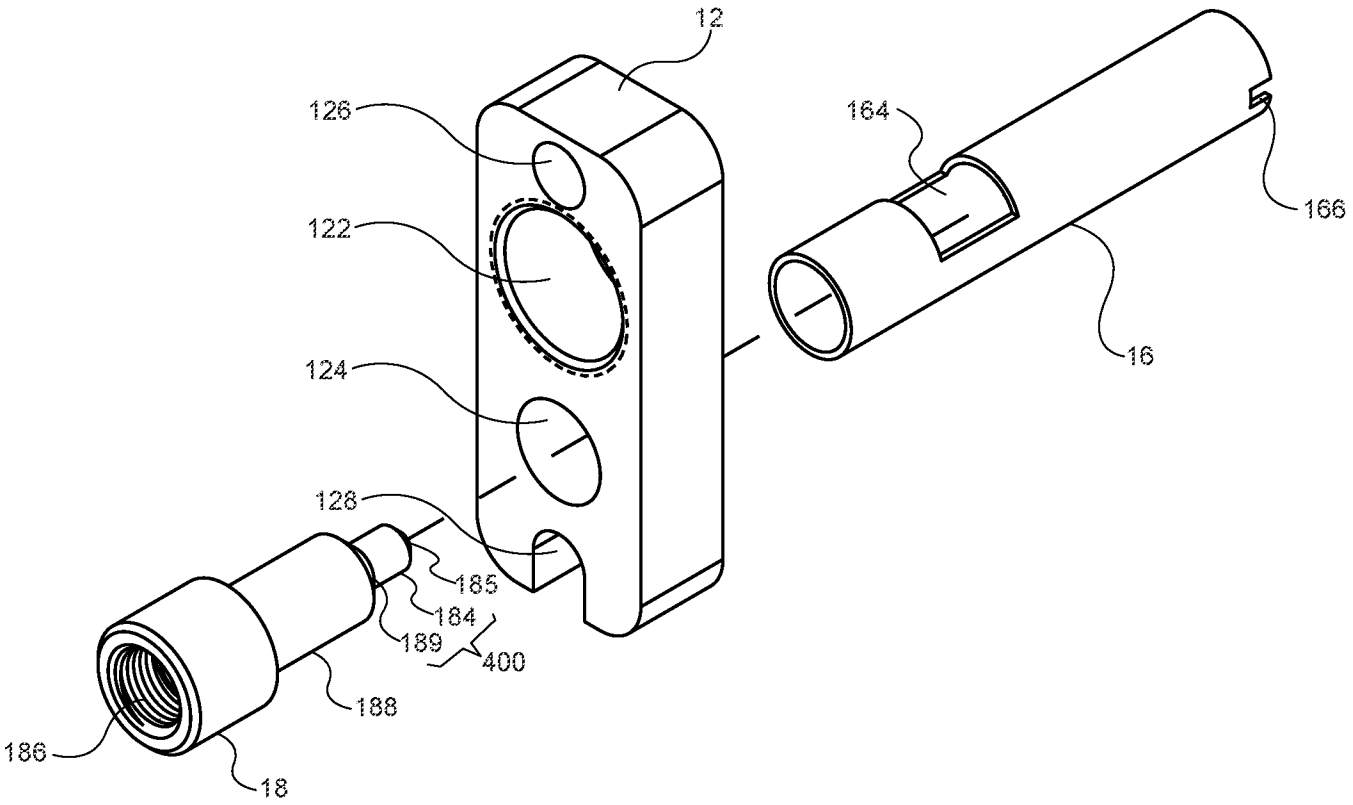
FIG. 5 is an exploded perspective view of the mounting plate with a gas orifice mount and a sleeve before installation in accordance with an aspect of the present disclosure.

In FIG. 5, the mounting plate 12 is shown before the pilot ignition rod assembly 14 and the sleeve 16 is installed. The diameter of the first opening 122 may be 0.75" and the diameter of the second opening 124 may be between 0.505" and 0.510". The first opening 122 of the mounting plate 12 may be tapered thread for easy installation of the pilot ignition rod assembly 14. The mounting plate 12 includes a third opening 126. The third opening 126 is configured for fixing the mounting plate 12 to the wall 24 outside of the heat exchanger 20. The mounting plate 12 also includes a fourth opening 128. Similar to the third opening 126, the fourth opening 128 is configured to fix the mounting plate 12 to the wall 24 outside of the heat exchanger 20. The diameters of the third and the fourth opening 126, 128 may be 0.17".

The gas orifice mount 18 includes a threaded portion 186, a first portion 188, a second portion 184, and a gas outlet 185. A tapered portion 189 may present between the first portion 188 and the second portion 184. The tapered portion 189 and the second portion 184 comprise a gas venturi 400. The inner diameter of the second portion 184 is smaller than the inner diameter of the first portion 188. As gas is supplied to the gas orifice mount 18 through the gas fitting 182, the gas flows to the first portion 188. When the gas flows to the second portion 184, because there is a decrease in diameter, the velocity of the gas in the second portion 184 increases and the gas pressure in the second portion 184 decreases. The funnel portion 189 may help to increase the velocity of the gas more smoothly. By changing the inner diameter of the first portion 188 and the second portion 184, the velocity of the gas supplied at the gas outlet 185 may be controlled. For example, the inner diameter of the first portion 188 is 0.31" and the inner diameter of the second portion 184 is 0.047".

The sleeve 16 includes a sleeve opening 164. The sleeve opening 164 is arranged and located to draw air in from the combustion chamber. For example, the length of the sleeve opening along the axial direction is 0.47". The sleeve opening 164 may be positioned such that when the gas orifice mount 18 is joined to the sleeve 16, the sleeve opening 164 is adjacent to the gas venturi 400 such that the venturi effect draws air in from the combustion chamber through the sleeve opening 164. For example, the gas outlet 185 may be positioned directly below the sleeve opening 164 or the gas outlet 185 may be positioned around the edge of the sleeve opening 164. Alternatively, the gas outlet 185 may be positioned slightly outside of the sleeve opening 164. For example, the sleeve opening is positioned from 0.56" to 1.03" measured from the first end of the sleeve 16. The end of the gas outlet 185 may be position 0.03" from the end of the sleeve opening 164.

The sleeve 16 is installed into the second opening 124 of the mounting plate 12 such that the first end of the sleeve 16 is aligned with the outer surface of the mounting plate 12. The sleeve 16 may be press fit into the second opening 124 of the mounting plate 12. In an exemplary aspect, the outer diameter of the sleeve 16 is 0.5" and the inner diameter of the second opening 124 is between 0.505" to 0.510". After the sleeve 16 is installed into the second opening 124, the gas orifice mount 18 is installed into the sleeve 16. The first portion 188 of the gas orifice mount 18 may be press fit into the sleeve 16. In an exemplary aspect, the outer diameter of the first portion 188 of the gas orifice mount 18 is between 0.42" and 0.425", and the inner diameter of the sleeve 16 is around 0.43". After the sleeve 16 and the gas orifice mount 18 are installed into the mounting plate 12, the ground rod 162 is fixed to the sleeve 16. However, the ground rod 162 may be fixed to the sleeve 16 prior to the installation of the sleeve 16 and the gas orifice mount 18 to the mounting plate 12.

Figure 6:
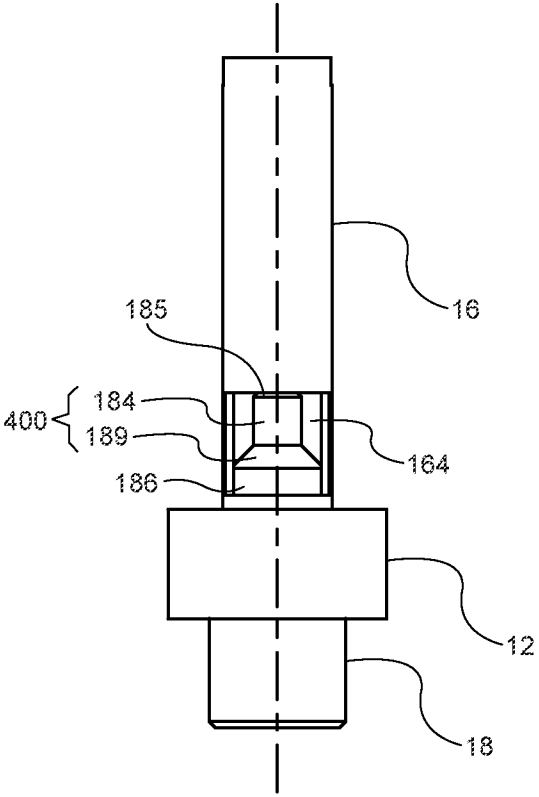
FIG. 6 is a plan view of a top of the gas orifice mount and the sleeve installed in the mounting plate in accordance with an aspect of the present disclosure.

In FIG. 6, a position of the gas outlet 185 in relation to the sleeve opening 164 is shown. The sleeve opening 164 is positioned adjacent to the gas venturi 400. When gas is supplied to the gas orifice mount 18, the fluid speed of the gas increases as the gas flows through the gas venturi 400. The relative pressure inside of the sleeve decreases and, as a result, air outside of the sleeve 16 flows into the sleeve 16 through the sleeve opening 164. The air drawn into the sleeve 16 is mixed with the gas from the gas outlet 185. The fluid speed of the gas from the gas outlet 185 and the size of the sleeve opening 164 may be calculated according to the required air needed to be mixed with gas. The mixture of air and gas is supplied to the gap between flame ionization rod 142 and the ground rod 162 through the second end of the sleeve 16 generating a flame when a spark is generated thereby igniting the main burner.

Back in FIG. 3, it will be described how each component of the pilot assembly 10 is positioned with respect to the heat exchanger 20. To protect components of the pilot assembly 10 from high temperature, most components of the pilot assembly 10 are position inside of the refractory material 22 except a portion of the flame ionization rod 142 and the ground rod 162. To establish a flame, air needs to be supplied to the pilot assembly 10. To supply air from the inside of combustion chamber 26, an air passage is established.

A refractory material opening 222 is provided in the refractory material 22 inside of the heat exchanger 20. The second end of the sleeve 16 and the flame ionization rod insulator 302 is positioned inside of the refractory material opening 222 to minimize contact with the high temperature of the combustion chamber 26. The refractory material opening 222 extends to the wall 24 through the thickness of the refractory material 22. However, it is not clearly shown in FIG. 3 because it is hidden behind the refractory material 22. The refractory material opening 222 is sized to accommodate insertion of both the sleeve 16 and the flame ionization rod insulator 302. The size of the refractory material opening 222 may increase or decrease along the thickness of the refractory material 22.

As shown in FIG. 3, the refractory material opening 222 is aligned with a wall opening 242 arranged in the wall 24. The wall opening 242 is then aligned with the sleeve opening 164. When gas is supplied to the gas orifice mount 18, the negative pressure formed inside of the sleeve 16 draws air from the combustion chamber 26 through the refractory material opening 22 and the wall opening 242 into the sleeve 16 through the sleeve opening 164.

The first joining means 246 is configured to fix the mounting plate 12 to the wall 24 of the heat exchanger 20. The second joining means 244 is configured to fix the mounting plate 12 to the wall 24 of the heat exchanger 20. By fixing the mounting plate 12 to the wall 24 of the heat exchanger 20, the mounting plate 12 may act as a sealing cover so that air from the wall opening 242 does not leak outside of the heat exchanger 20.

While described in the context of a spark ignition pilot assembly for use in a heat exchanger, it should be understood that the device and methods described herein can be applied in any application requiring ignition of combustion gases. For example, the spark ignition pilot assembly may be used for household air heater to wellhead gas burner. The spark ignition pilot assembly may be also used for furnace, boiler, and any appliance that requires a burner.

What is claimed is:

1. An apparatus for lighting a burner of a heat exchanger, the apparatus comprising:

a mounting plate configured to be mounted to said heat exchanger, said mounting plate comprising a first and second opening;

a pilot ignition rod assembly installed in said first opening, said pilot ignition rod assembly comprising a flame ionization rod and a terminal; and a sleeve coupled to and aligned with said second opening and configured to extend substantially through a refractory material lining a combustion chamber of said heat exchanger, said sleeve being joined to a ground rod on a distal end and a gas orifice mount on a proximal end, said gas orifice mount including a gas venturi surrounded by said sleeve, wherein said sleeve is sized to extend from said mounting plate through an opening in said refractory material lining said combustion chamber, wherein said sleeve includes a sleeve opening adjacent to said gas venturi, said sleeve opening configured to allow air to flow from said combustion chamber to said gas venturi.

2. The apparatus according to claim 1, wherein said mounting plate is configured to be mounted to a wall outside of said refractory material of said heat exchanger.

3. The apparatus according to claim 2, wherein said wall comprises a wall opening aligned with a refractory material opening arranged on said refractory material and aligned with said sleeve opening.

4. An apparatus according to claim 3, wherein air is supplied to said sleeve through said refractory material opening on said refractory material and said wall opening on said wall from said combustion chamber.

5. The apparatus according to claim 1, wherein said flame ionization rod is configured to detect a flame by monitoring an electrical current flow.

6. The apparatus according to claim 1, further comprising a gas fitting configured to supply gas installed on said gas orifice mount.

7. The apparatus according to claim 1, wherein said pilot ignition rod assembly further comprising an insulator configured to cover a portion of said flame ionization rod.

8. The apparatus according to claim 1, wherein said sleeve and said gas orifice mount are joined by welding.

9. The apparatus according to claim 1, wherein said ground rod is made of Kanthal™.

10. The apparatus according to claim 1, wherein said sleeve comprises a slot and said ground rod is joined to said slot by welding with silver solder.

11. The apparatus according to claim 1, wherein said sleeve is made of stainless steel.

12. The apparatus according to claim 1, wherein a gap between said flame ionization rod and said ground rod is between ⅛" and ¼".

13. The apparatus according to claim 1, wherein said gas orifice mount comprises a threaded portion, a first portion with a first inner diameter, a second portion with a second inner diameter, and a gas outlet.

14. The apparatus according to claim 13, wherein said first portion is proximal to said threaded portion and said second portion is distal to said threaded portion, wherein said gas outlet is arranged on said second portion, wherein said first inner diameter is larger than said second inner diameter.

15. The apparatus according to claim 14, wherein said gas orifice mount further comprises a funnel portion between said first portion and said second portion.

16. The apparatus according to claim 14, wherein said gas orifice mount is joined with said sleeve such that said second portion of said gas orifice mount is arranged inside of said sleeve.

17. The apparatus according to claim 14, wherein a decrease in said inner diameters of said gas orifice mount is configured to increase a velocity of a gas supplied to said gas outlet.

18. The apparatus according to claim 17, wherein said increased velocity of said gas is configured to create a negative pressure in said sleeve to draw air from said opening of said sleeve.

19. The apparatus according to claim 1, wherein said mounting plate further comprising a third opening to fix said mounting plate to said heat exchanger with a joining mean.

20. The apparatus according to claim 6, wherein said gas fitting is made of brass.

* * * * *